US007596818B2

(12) United States Patent
Sutton

(10) Patent No.: US 7,596,818 B2
(45) Date of Patent: Oct. 6, 2009

(54) DISPOSABLE AIR EXHAUST SYSTEM FOR ELIMINATING AEROSOL EFFECT IN A TOILET

(76) Inventor: Bernard Sutton, 3841 Kensington Rd. - Apt. E 42, Decatur, GA (US) 30032

( * ) Notice: Subject to any disclaimer, the term of this patent is extended or adjusted under 35 U.S.C. 154(b) by 551 days.

(21) Appl. No.: 11/202,767

(22) Filed: Aug. 12, 2005

(65) Prior Publication Data

US 2006/0064804 A1 Mar. 30, 2006

Related U.S. Application Data

(60) Provisional application No. 60/613,957, filed on Sep. 28, 2004.

(51) Int. Cl.
*E03D 9/04* (2006.01)

(52) U.S. Cl. ..... 4/213

(58) Field of Classification Search ..... 4/352, 4/347, 348, 209 R, 213, 216, 217
See application file for complete search history.

(56) References Cited

U.S. PATENT DOCUMENTS 4,025,325 A * 5/1977 Goodwin, Jr. ..... 55/357
4,944,045 A * 7/1990 Agelatos et al. ..... 4/213
5,727,263 A * 3/1998 Hugo Ceja Estrada ..... 4/216
6,167,576 B1 * 1/2001 Sollami ..... 4/217
6,298,500 B1 * 10/2001 Sollami ..... 4/217
6,305,325 B1 * 10/2001 Sullivan ..... 119/600
6,567,994 B1 * 5/2003 Spurr et al. ..... 4/217
2005/0138720 A1 * 6/2005 Shim ..... 4/213
2006/0248634 A1 * 11/2006 Sollami ..... 4/217

* cited by examiner

*Primary Examiner*—Huyen Le
(74) *Attorney, Agent, or Firm*—Charles E. Baxley

(57) ABSTRACT

A disposable air exhaust system for eliminating aerosol effect in a toilet. The disposable air exhaust system includes first apparatus, second apparatus, and a suction device. The first apparatus disposably attaches to a rim of a bowl of the toilet and imparts a suction thereat to remove odorous particles and odorous air therefrom. The second apparatus disposably attaches to a seat of the toilet and imparts a suction thereat to remove odorous particles and odorous air therefrom. The suction device fluidly communicates with both the first apparatus and the second apparatus to create the suctions thereat to remove the odorous particles and the odorous air thereat, thereby eliminating the aerosol effect in the toilet.

36 Claims, 7 Drawing Sheets

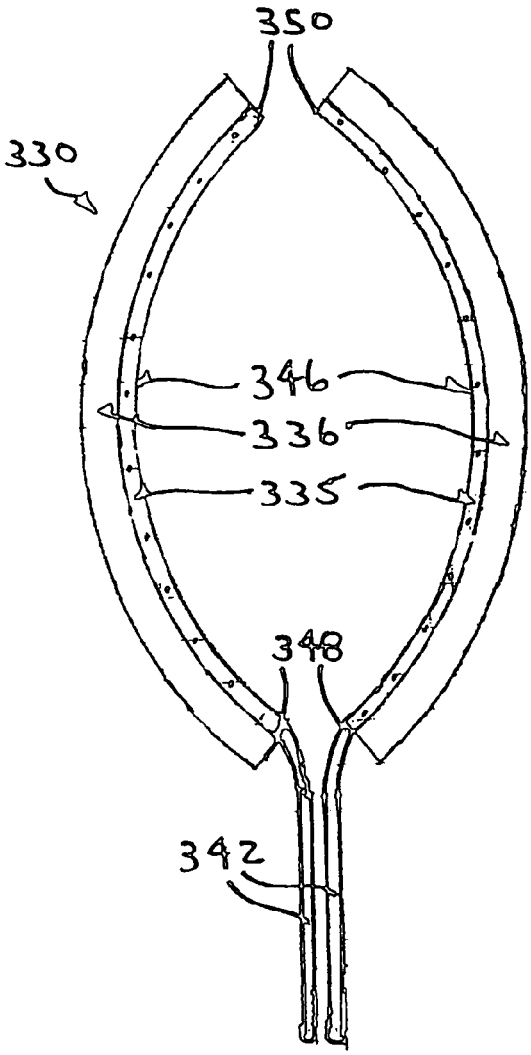
FIG. 5
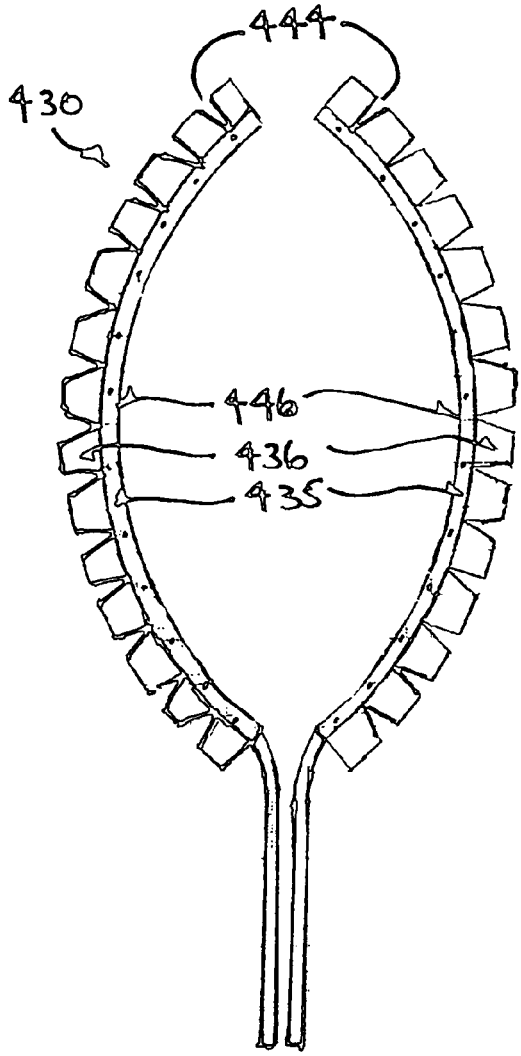
FIG. 6
FIG. 3
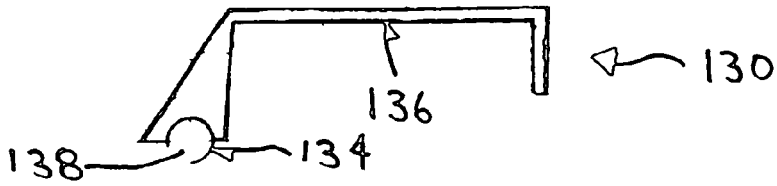

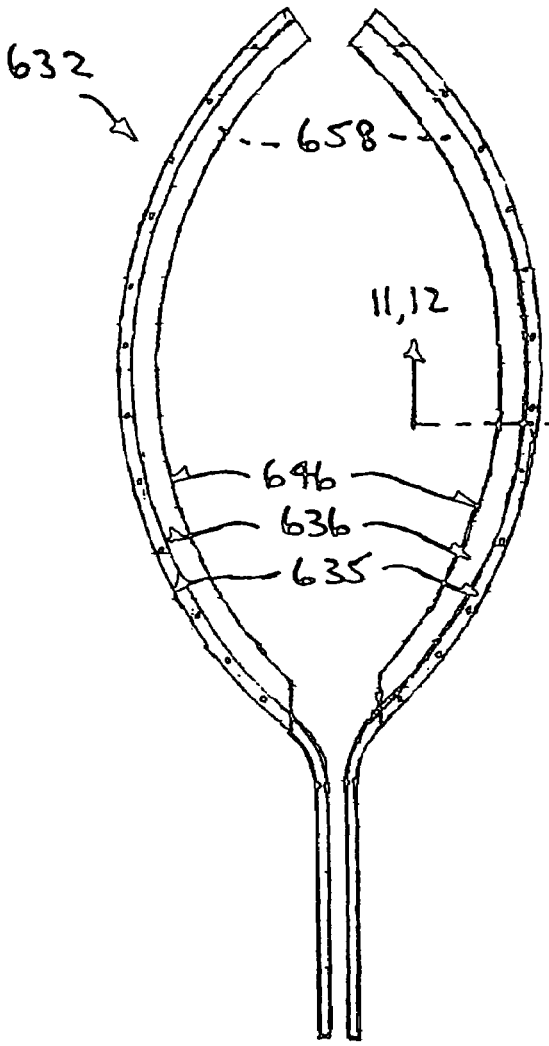
FIG. 10
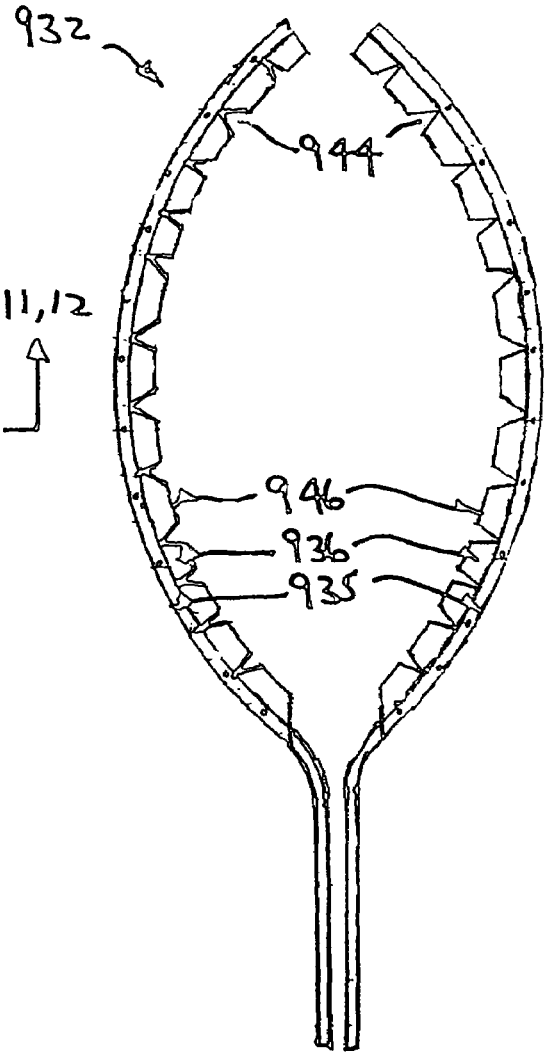
FIG. 13
FIG. 11
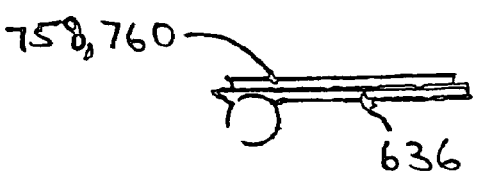
FIG. 12
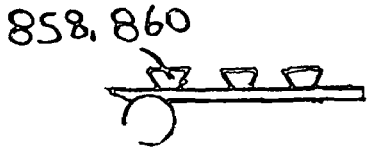

DISPOSABLE AIR EXHAUST SYSTEM FOR ELIMINATING AEROSOL EFFECT IN A TOILET

1. CROSS REFERENCE TO RELATED APPLICATIONS

The instant non-provisional application claims priority from provisional application No. 60/613,957, filed Sep. 28, 2004, and entitled DISPOSABLE TOILET BOWL AND TOILET SEAT AIR EXHAUST SYSTEM.

2. BACKGROUND OF THE INVENTION

A. Field of the Invention

The present invention relates to a disposable air exhaust system, and more particularly, the present invention relates to a disposable air exhaust system for eliminating aerosol effect in a toilet.

B. Description of the Prior Art

[1]In 1975, Dr. Charles Gerba—a University of Arizona Microbiologist—published a study regarding the "aerosol effect" in toilets. The study dealt with bacterial and viral aerosols as a result of flushing the toilet.

[1] "Think before you flush or brush" @ www.serendip.com.

According to Gerba, "[d]roplets are going all over the place—it's like the Fourth of July." His "studies nave shown that water droplets in an invisible cloud travel six to eight feet out and up, so the areas of the bathroom (restroom) not directly adjacent the toilet are still contaminated" and that "the bacterial mist has also been shown to stay in the air for at least two hours after each flush, thus maximizing its chance to float around and spread." "* * * [B]athrooms should be cleaned even more meticulously than before, with emphasis not just on and around the toilet, but equal emphasis on all areas of the bathroom because all areas are equally affected by the spray."

Dr. Philip Tierno—Director of Clinical Microbiology and Diagnostic Immunology at NY—stated that "[t]he greatest aerosol dispersal occurs not during the initial moments of the flush, but rather once most of the water has already left the bowl." He advises leaving the (bathroom-restroom) immediately after flushing to not have the microscopic, airborne mist land on you. "Worse still is the possibility of getting these airborne particles in the lungs by inhaling them, from which one could easily contract a cough or cold."

[2]"One reason bathrooms (restrooms) are conducive to bacteria is because of the basic nature of a bathroom (restroom). There are 120 viruses in feces, so when a toilet is flushed water particles with more than 25,000 virus particles and 600,000 bacteria are ejected from the toilet bowl and can settle on any surface as far as six feet away from the toilet. These particles will last several hours and have the potential, especially in public toilets, to cause disease. These water particles can contain bacteria like salmonella, *E. coli,* or streptococcus pygoenes * * *."

[2] "Dirty Business" @ www.jrscience.com.

"These are only three of the 600,000 bacteria that are ejected from the toilet bowl after one flush." And "it has now been established from research that the middle stalls in public restrooms are the most commonly used and thus the most contaminated * * * it becomes apparent as to why a public bathroom (restroom) is a breeding ground for bacteria * * *."

"* * * We are interested in finding out how germ-infested public bathrooms really are since we have to use them every day. Germs and bacteria are also something to be concerned with when living with a large group of people because they have the potential to spread so quickly. Determining which stall is the least contaminated, allows a person to attempt to reduce their exposure to disease-causing bacterial and viruses, and thus lower their chance of getting themselves and those around them sick."

This information is significant in that it supports the fact that inhaling the airborne particles can be very unhealthy. It is important regarding groups or large numbers of people who use public restrooms. Regarding the "aerosol effect," the "aerosol effect * * * can be summed up as the F3 force: Fecal Fountain Factor * * *." Stomach and intestinal aerosol fecal dispersal—water mist with fecal matter from many different people floating around all day in public restrooms.

The 2-hour rule does not apply here. Public toilets can be viewed as any bathroom or restroom that is not private as the home. Regarding all public toilets, multiply the number of people who use them by the above bacteria and viral numbers to grasp the realities. The home bathroom also causes problems.

Thus, there exists a need for a disposable air exhaust system for eliminating aerosol effect in a toilet.

3. SUMMARY OF THE INVENTION

Accordingly, an object of the present invention is to provide a disposable air exhaust system for eliminating aerosol effect in a toilet that avoids the disadvantages of the prior art.

Briefly stated, another object of the present invention is to provide a disposable air exhaust system for eliminating aerosol effect in a toilet. The disposable air exhaust system includes first apparatus, second apparatus, and a suction device. The first apparatus disposably attaches to a rim of a bowl of the toilet and imparts a suction thereat to remove offensive odorous particles and offensive odorous air therefrom. The second apparatus disposably attaches to a seat of the toilet and imparts a suction thereat to remove offensive odorous particles and offensive odorous air therefrom. The suction device fluidly communicates with both the first apparatus and the second apparatus to create the suctions thereat to remove the offensive odorous particles and the offensive odorous air thereat, thereby eliminating the aerosol effect in the toilet.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

4. BRIEF DESCRIPTION OF THE DRAWING

The figures of the drawing are briefly described as follows:

FIG. 3 is an enlarged diagrammatic cross sectional view taken along LINE 3-3 in FIG. 2;

FIG. 5 is a diagrammatic top plan view of the area generally enclosed by the dotted curve identified by ARROW 5 in FIG. 1 of a third embodiment of the first apparatus of the disposable air exhaust system of the present invention;

FIG. 6 is a diagrammatic top plan view of the area generally enclosed by the dotted curve identified by ARROW 6 in FIG. 1 of a fourth embodiment of the first apparatus of the disposable air exhaust system of the present invention;

FIG. 10 is a diagrammatic bottom plan view of the area generally enclosed by the dotted curve identified by ARROW 10 in FIG. 1 of a first embodiment of the second apparatus of the disposable air exhaust system of the present invention;

FIG. 11 is an enlarged diagrammatic cross sectional view taken along LINE 11-11 in FIG. 10 of a first embodiment of the attaching apparatus of the first, second, and third embodiments of the second apparatus of the disposable air exhaust system of the present invention;

FIG. 12 is an enlarged diagrammatic cross sectional view taken along LINE 12-12 in FIG. 10 of a second embodiment of the attaching apparatus of the first, second, and third embodiments of the second apparatus of the disposable air exhaust system of the present invention;

FIG. 13 is a diagrammatic bottom plan view of the area generally enclosed by the dotted curve identified by ARROW 13 in FIG. 1 of a second embodiment of the second apparatus of the disposable air exhaust system of the present invention;

Figure 1:
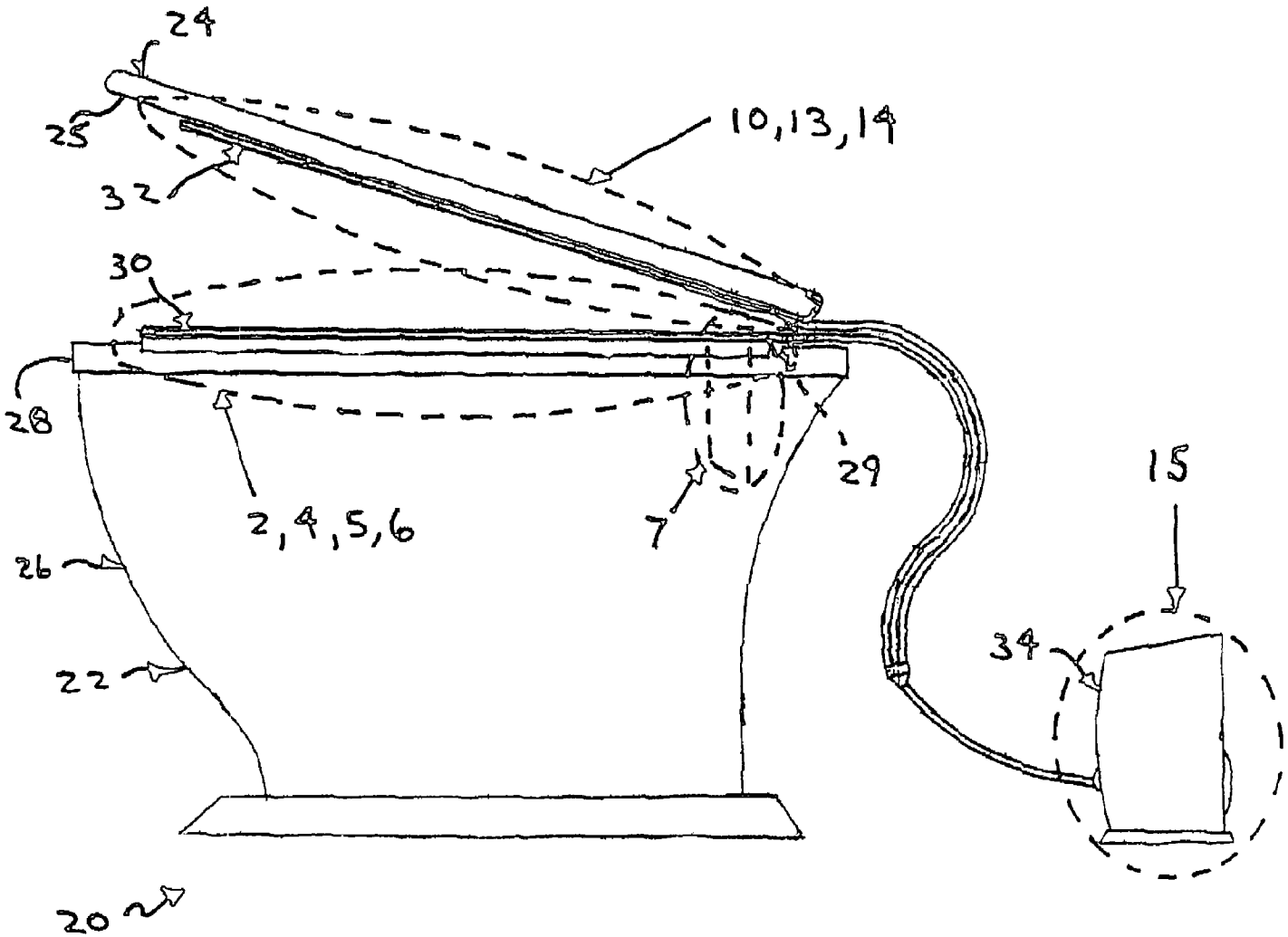
FIG. 1 is a diagrammatic side elevational view of the disposable air exhaust system of the present invention eliminating aerosol effect in a toilet.
Figure 14:
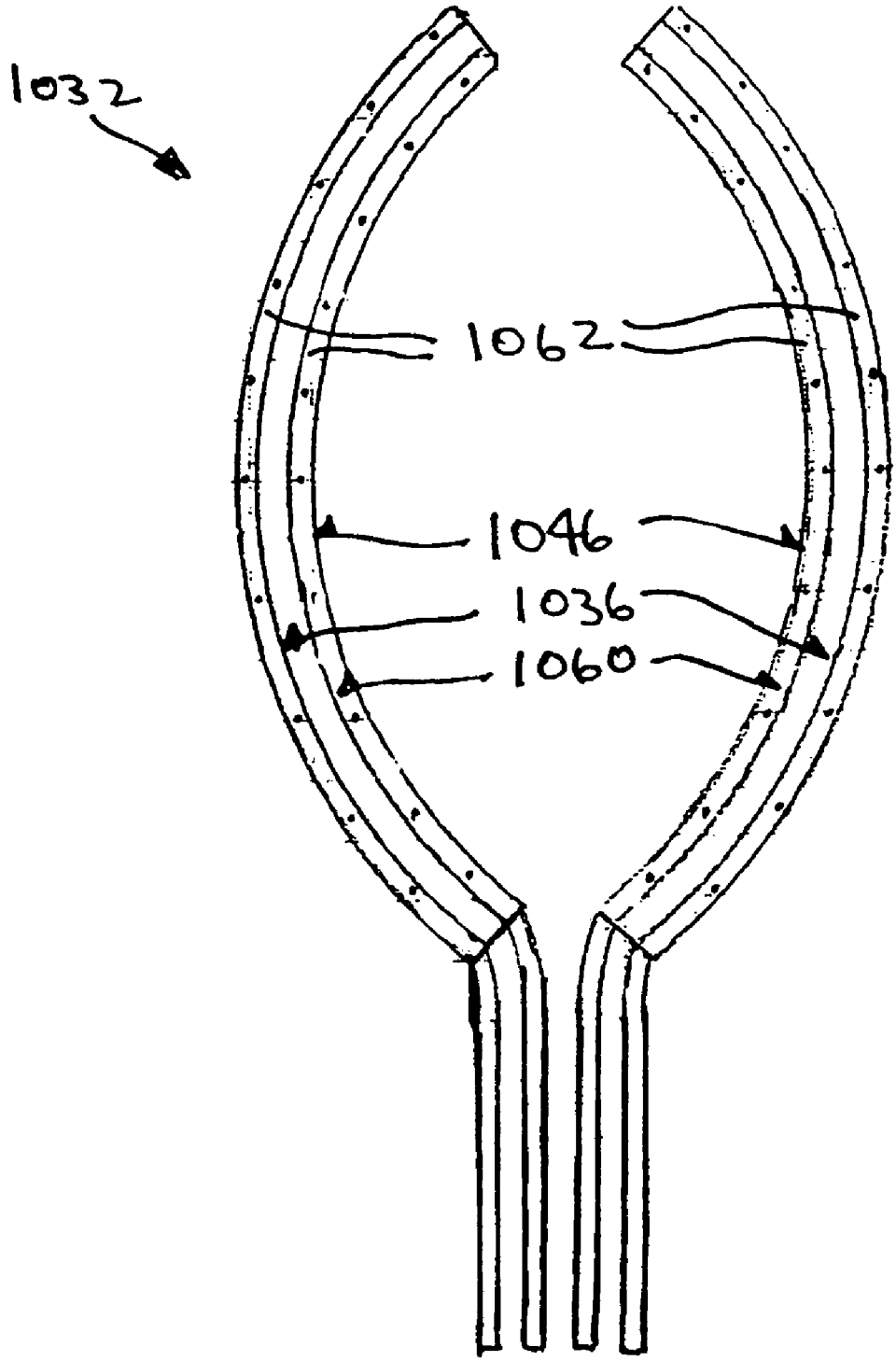
Figure 15:
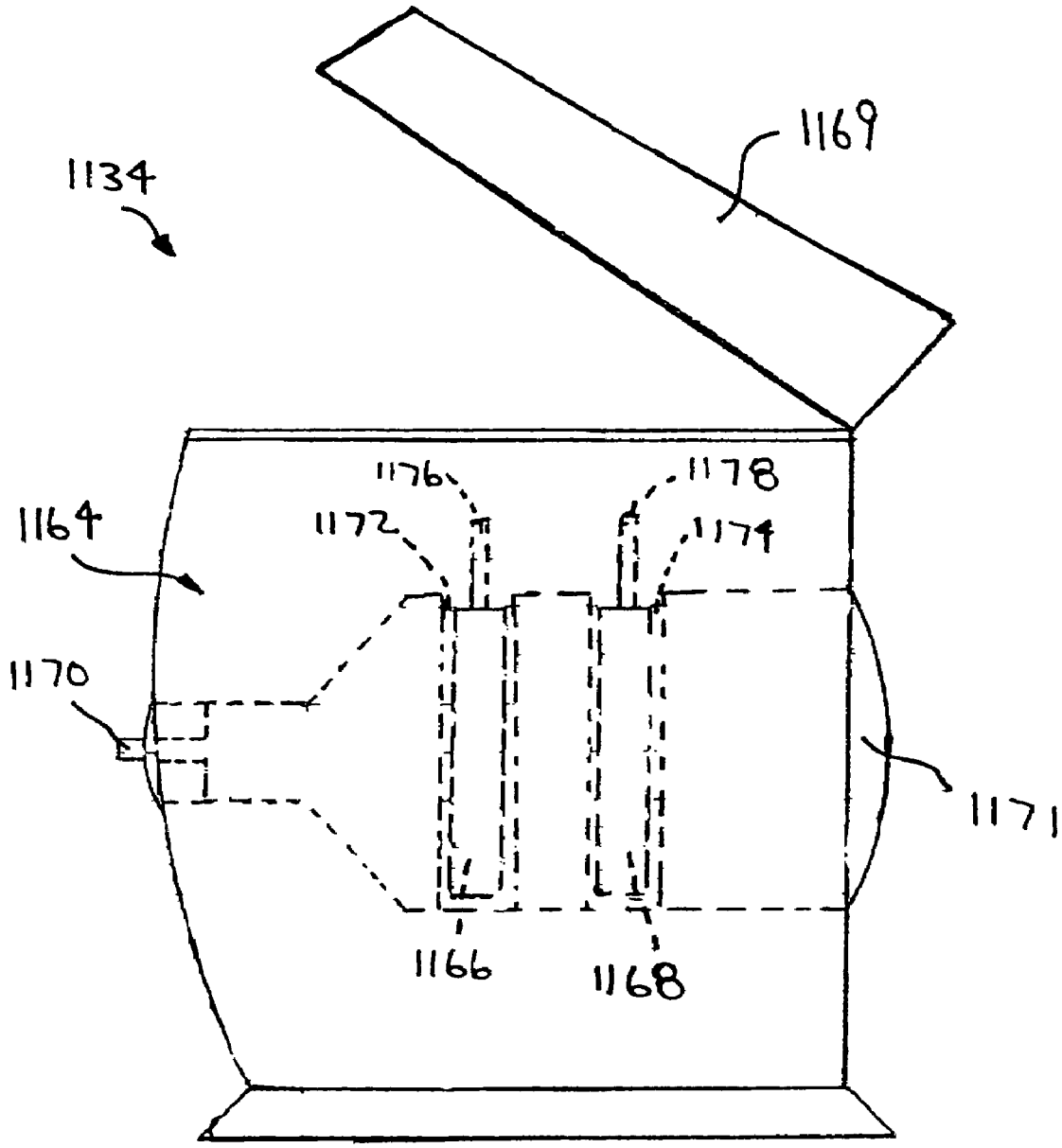

FIG. 14 is a diagrammatic bottom plan view of the area generally enclosed by the dotted curve identified by ARROW 14 in FIG. 1 of a third embodiment of the second apparatus of the disposable air exhaust system of the present invention; and FIG. 15 is an enlarged diagrammatic side elevational view of the area generally enclosed by the dotted curve identified by ARROW 15 in FIG. 1 of the suction device of the disposable air exhaust system of the present invention.

5. LIST OF REFERENCE NUMERALS UTILIZED IN THE DRAWING

A. General

20 disposable air exhaust system of present invention for eliminating aerosol effect in toilet 22
22 toilet
24 seat of toilet 22
25 bottom surface of seat 24 of toilet 22
26 bowl of toilet 22
28 rim of bowl 26 of toilet 22
29 back of rim 28 of bowl 26 of toilet 22
30 first apparatus for disposably attaching to rim 28 of bowl 26 of toilet 22 and for imparting suction thereat to remove offensive odorous particles and offensive odorous air therefrom
32 second apparatus for disposably attaching to seat 24 of toilet 22 and for imparting suction thereat to remove offensive odorous particles and offensive odorous air therefrom
34 suction device for creating suctions at first apparatus 30 and second apparatus 32 to remove offensive odorous particles and offensive odorous air thereat, thereby eliminating aerosol effect in toilet 22

B. First Embodiment of First Apparatus

130 first apparatus
135 conduit of first apparatus 130
136 hook of first apparatus 130 for hooking over rim 28 of bowl 26 of toilet 22 so as to allow conduit 135 of first apparatus 130 to lay inside of, and impart suction at, rim 28 of bowl 26 of toilet 22 to remove offensive odorous particles and offensive odorous air therefrom
138 plurality of openings in conduit 135 of first apparatus 130 for imparting suction at rim 28 of bowl 26 of toilet 22 to remove offensive odorous particles and offensive odorous air therefrom
140 pair of ends of conduit 135 of first apparatus 130
142 pair of tubes of first apparatus 130

C. Second Embodiment of First Apparatus

230 first apparatus
235 conduit of first apparatus 230
236 hook of first apparatus 230 for hooking over rim 28 of bowl 26 of toilet 22 so as to allow conduit 235 of first apparatus 230 to lay inside of, and impart suction at, rim 28 of bowl 26 of toilet 22 to remove offensive odorous particles and offensive odorous air therefrom
244 cutouts in hook 236 of first apparatus 230

D. Third Embodiment of First Apparatus

330 first apparatus
335 conduit of each separate portion of pair of separate portions 346 of first apparatus 330
336 hook of each separate portion of pair of separate portions 346 of first apparatus 330 for hooking over rim 28 of bowl 26 of toilet 22 so as to allow conduit 335 of first apparatus 330 to lay inside of, and impart suction at, rim 28 of bowl 26 of toilet 22 to remove offensive odorous particles and offensive odorous air therefrom
342 tube of each separate portion of pair of separate portions 346 of first apparatus 330
346 pair of separate portions of first apparatus 330
348 proximal end of conduit 335 of each separate portion of pair of separate portions 346 of first apparatus 330
350 distal end of conduit 335 of each separate portion of pair of separate portions 346 of first apparatus 330

E. Fourth Embodiment of First Apparatus

430 first apparatus
435 conduit of each separate portion of pair of separate portions 446 of first apparatus 430
436 hook of each separate portion of pair of separate portions 446 of first apparatus 430 for hooking over rim 28 of bowl 26 of toilet 22 so as to allow conduit 435 of first apparatus 430 to lay inside of, and impart suction at, rim 28 of bowl 26 of toilet 22 to remove offensive odorous particles and offensive odorous air therefrom
444 cutouts in hook 436 of each separate portion of pair of separate portions 446 of first apparatus 430

F. Remaining Portion of First Apparatus

550 remaining portion of first apparatus 30, 130, 230, 330, 430

552 scoop of remaining portion of first apparatus 30, 130, 230, 330, 430

554 hooks of remaining portion 550 of first apparatus 30, 130, 230, 330, 430 for hooking over back 29 of rim 28 of bowl 26 of toilet 22 so as to allow scoop 552 of remaining portion 550 of first apparatus 30, 130, 230, 330, 430 to lay inside of, and impart suction at, back 29 of rim 28 of bowl 26 of toilet 22 to remove offensive odorous particles and offensive odorous air therefrom

555 mouth of scoop 552 of remaining portion 550 of first apparatus 30, 130, 230, 330, 430 for imparting suction

556 throat of scoop 552 of remaining portion 550 of first apparatus 30, 130, 230, 330, 430

G. First Embodiment of Second Apparatus

632 second apparatus

635 conduit of each separate portion of pair of separate portions 646 of second apparatus 632

636 flange of each separate portion of pair of separate portions 646 of second apparatus 632 for disposably attaching to bottom surface 25 of seat 24 of toilet 22

646 pair of separate portions of second apparatus 632

658 attaching apparatus of second apparatus 632 for attaching each separate portion of pair of separate portions 646 of second apparatus 632 to bottom surface 25 of seat 24 of toilet 22

H. First Embodiment of Attaching Apparatus

758 attaching apparatus

760 adhesive of attaching apparatus 758

I. Second Embodiment of Attaching Apparatus

858 attaching apparatus

860 suction cups of attaching apparatus 858

J. Second Embodiment of Second Apparatus

932 second apparatus

935 conduit of each separate portion of pair of separate portions 946 of second apparatus 932

936 flange of each separate portion of pair of separate portions 946 of second apparatus 932

944 cutouts in flange 936 of each separate portion of pair of separate portions 946 of second apparatus 932

946 pair of separate portions of second apparatus 932

K. Third Embodiment of Second Apparatus

1032 second apparatus

1036 flange of each separate portion of pair of separate portions 1046 of second apparatus 1032

1046 pair of separate portions of second apparatus 1032

1060 another conduit of each separate portion of pair of separate portions 1046 of second apparatus 1032

1062 pair of conduits of each separate portion of pair of separate portions 1046 of second apparatus 1032

L. Suction Device

1134 suction device

1164 housing of suction device 1134

1166 filter of suction device 1134

1168 fragrance generator of suction device 1134

1169 openable top of housing 1164 of suction device 1134

1170 intake of housing 1164 of suction device 1134

1171 exhaust of housing 1164 of suction device 1134

1172 first slot in housing 1164 of suction device 1134

1174 second slot in housing 1164 of suction device 1134

1176 first tab of suction device 1134

1178 second tab of suction device 1134

6. DETAILED DESCRIPTION OF THE PREFERRED EMBODIMENT

A. General

Referring now to the figures, in which like numerals indicate like parts, and particularly to FIG. 1, which is a diagrammatic side elevational view of the disposable air exhaust system of the present invention eliminating aerosol effect in a toilet, the disposable air exhaust system of the present invention is shown generally at 20 for eliminating aerosol effect in a toilet 22, wherein the toilet 22 has a seat 24 with a bottom surface 25 and a shape, wherein the toilet 22 further has a bowl 26 with a rim 28, and wherein the rim 28 of the bowl 26 of the toilet 22 has a shape and a back 29.

The disposable air exhaust system 20 comprises first apparatus 30, second apparatus 32, and a suction device 34. The first apparatus 30 is for disposably attaching to the rim 28 of the bowl 26 of the toilet 22 and for imparting a suction thereat to remove offensive odorous particles and offensive odorous air therefrom. The second apparatus 32 is for disposably attaching to the seat 24 of the toilet 22 and for imparting a suction thereat to remove offensive odorous particles and offensive odorous air therefrom. The suction device 34 fluidly communicates with both the first apparatus 30 and the second apparatus 32 for creating the suctions thereat to remove the offensive odorous particles and the offensive odorous air thereat, thereby eliminating the aerosol effect in the toilet 22.

B. First Embodiment of the First Apparatus

Figure 2:
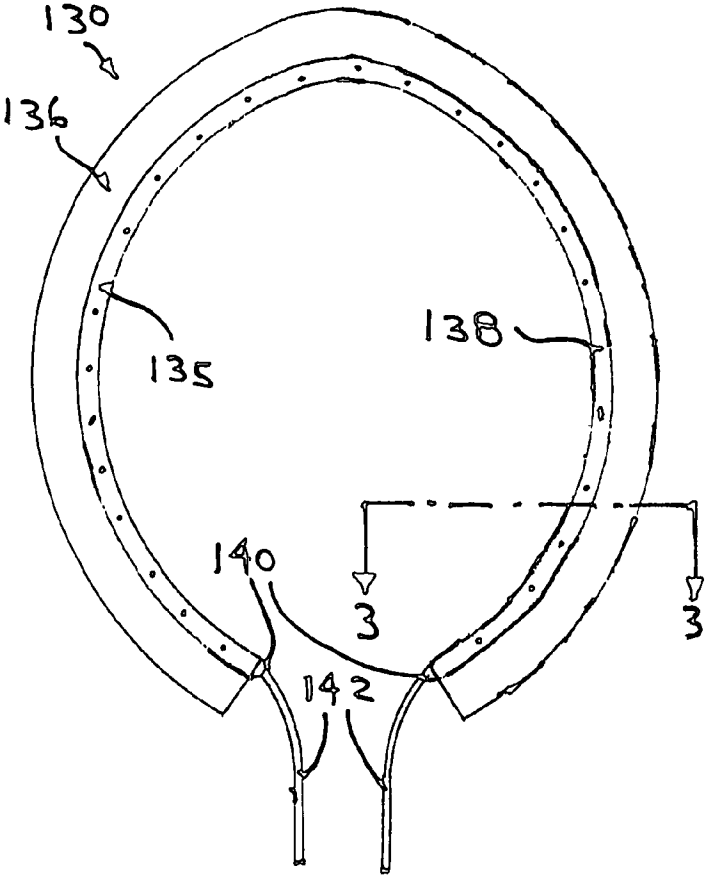
FIG. 2 is a diagrammatic top plan view of the area generally enclosed by the dotted curve identified by ARROW 2 in FIG. 1 of a first embodiment of the first apparatus of the disposable air exhaust system of the present invention.

The configuration of a first embodiment of the first apparatus 130 can best be seen in FIGS. 2 and 3, which are, respectively, a diagrammatic top plan view of the area generally enclosed by the dotted curve identified by ARROW 2 in FIG. 1 of a first embodiment of the first apparatus of the disposable air exhaust system of the present invention, and, an enlarged diagrammatic cross sectional view taken along LINE 3-3 in FIG. 2, and as such, will be discussed with reference thereto.

The first apparatus 130 comprises a conduit 135 and a hook 136. The hook 136 of the first apparatus 130 extends laterally outwardly from the conduit 135 of the first apparatus 130 and is for hooking over the rim 28 of the bowl 26 of the toilet 22 so as to allow the conduit 135 of the first apparatus 130 to lay inside of, and impart the suction at, the rim 28 of the bowl 26 of the toilet 22 to remove the offensive odorous particles and the offensive odorous air therefrom.

The first apparatus 130 is continuous for extending continuously around the rim 28 of the bowl 26 of the toilet 22, thereby allowing both the hook 136 of the first apparatus 130 and the conduit 135 of the first apparatus 130 to extend continuously around the rim 28 of the bowl 26 of the toilet 22.

The conduit 135 of the first apparatus 130 has a plurality of openings 138 and a pair of ends 140. The plurality of openings 138 in the conduit 135 of the first apparatus 130 are spaced therealong in a depending manner and are for imparting the suction at the rim 28 of the bowl 26 of the toilet 22 to remove the offensive odorous particles and the offensive odorous air therefrom. The pair of ends 140 of the conduit 135 of the first apparatus 130 extend into a pair of tubes 142 that fluidly communicate with the suction device 34 to transport the offensive odorous particles and the offensive odorous air from the conduit 135 of the first apparatus 130 to the suction device 34.

C. Second Embodiment of the First Apparatus

Figure 4:
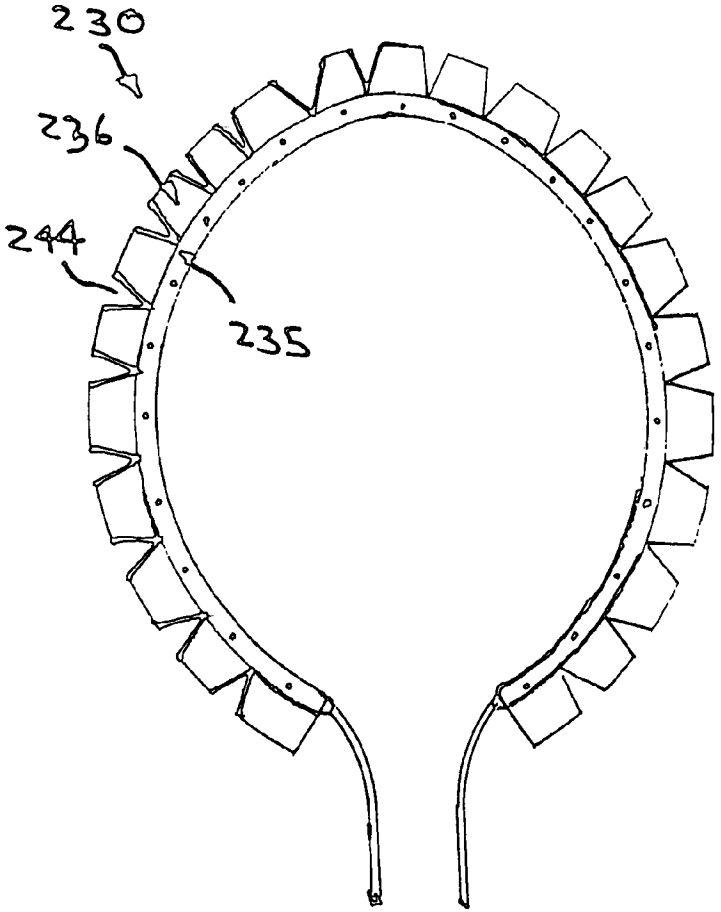
FIG. 4 is a diagrammatic top plan view of the area generally enclosed by the dotted curve identified by ARROW 4 in FIG. 1 of a second embodiment of the first apparatus of the disposable air exhaust system of the present invention.

The configuration of a second embodiment of the first apparatus 230 can best be seen in FIG. 4, which is a diagrammatic top plan view of the area generally enclosed by the dotted curve identified by ARROW 4 in FIG. 1 of a second embodiment of the first apparatus of the disposable air exhaust system of the present invention, and as such, will be discussed with reference thereto.

The first apparatus 230 is similar to the first apparatus 130, except that the conduit 235 of the first apparatus 230 is flexible and the hook 236 of the first apparatus 230 contains cutouts 244. The cutouts 244 in the hook 236 of the first apparatus 230 are preferably V-shaped, are spaced therealong, extend laterally therein, and allow the conduit 235 of the first apparatus 230 to flex and generally assume the shape of the rim 28 of the bowl 26 of the toilet 22.

D. Third Embodiment of the First Apparatus

The configuration of a third embodiment of the first apparatus 330 can best be seen in FIG. 5, which is a diagrammatic top plan view of the area generally enclosed by the dotted curve identified by ARROW 5 in FIG. 1 of a third embodiment of the first apparatus of the disposable air exhaust system of the present invention, and as such, will be discussed with reference thereto.

The first apparatus 330 is similar to the first apparatus 130, except that it is not continuous, but rather is a pair of separate portions 346. Each separate portion 346 of the first apparatus 330 has a conduit 335 and a hook 336. The conduit 335 of each separate portion 346 of the first apparatus 330 has a proximal end 348 and a distal end 350. The distal end 350 of the conduit 335 of each separate portion 346 of the first apparatus 330 is sealed, while the proximal end 348 of the conduit 335 of each separate portion 346 of the first apparatus 330 extends into a tube 342 that fluidly communicates with the suction device 34 to transport the offensive odorous particles and the offensive odorous air from the conduit 335 of each separate portion 346 of the first apparatus 330 to the suction device 34.

E. Fourth Embodiment of the First Apparatus

The configuration of a fourth embodiment of the first apparatus 430 can best be seen in FIG. 6, which is a diagrammatic top plan view of the area generally enclosed by the dotted curve identified by ARROW 6 in FIG. 1 of a fourth embodiment of the first apparatus of the disposable air exhaust system of the present invention, and as such, will be discussed with reference thereto.

The first apparatus 430 is similar to the first apparatus 330, except that the conduit 435 of each separate portion 446 of the first apparatus 430 is flexible and the hook 436 of each separate portion 446 of the first apparatus 430 contains cutouts 444. The cutouts 444 in the hook 436 of each separate portion 446 of the first apparatus 430 are preferably V-shaped, are spaced therealong, extend laterally therein, and allow an associated conduit 435 of each separate portion 446 of the first apparatus 430 to flex and generally assume the shape of the rim 28 of the bowl 26 of the toilet 22.

F. Remaining Portion of the First Apparatus

Figure 7:
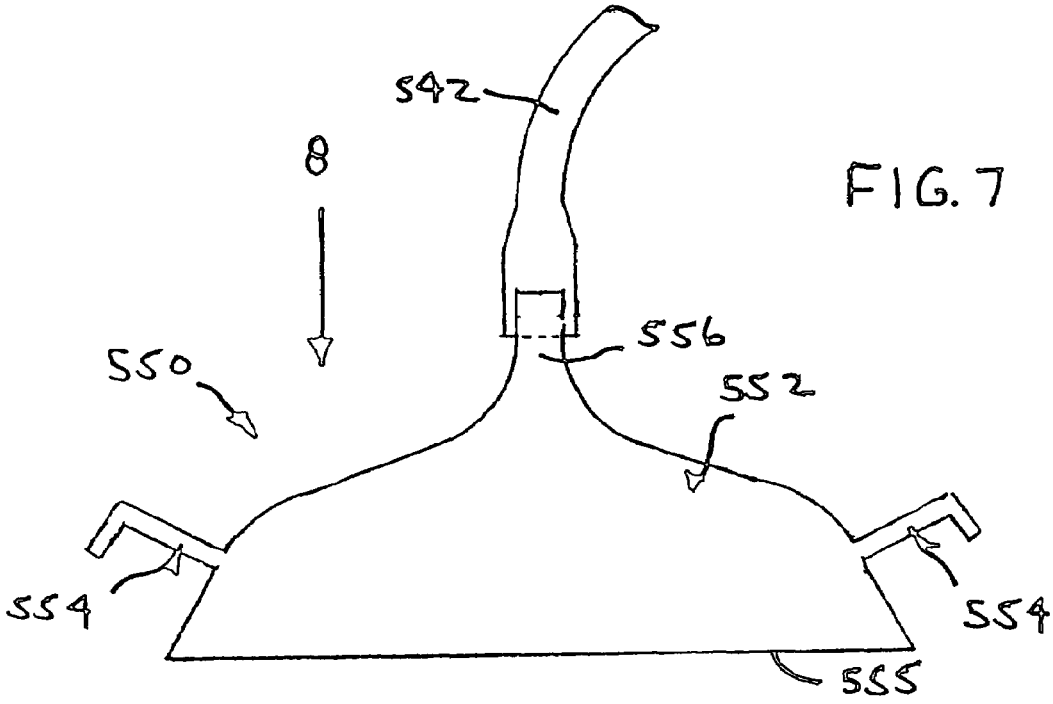
FIG. 7 is enlarged diagrammatic front elevational view of the area generally enclosed by the dotted curve identified by ARROW 7 in FIG. 1 of a remaining portion of the first apparatus of the disposable air exhaust system of the present invention.
Figure 8:
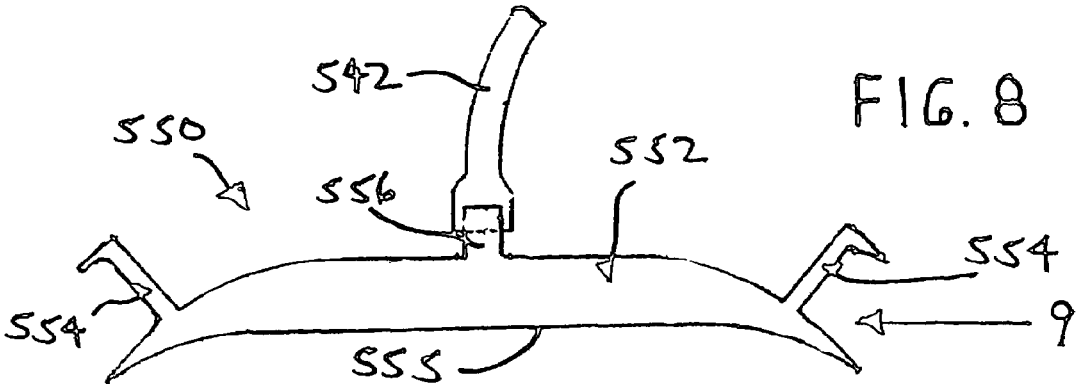
FIG. 8 is a diagrammatic top plan view taken generally in the direction of ARROW 8 in FIG. 7.
Figure 9:
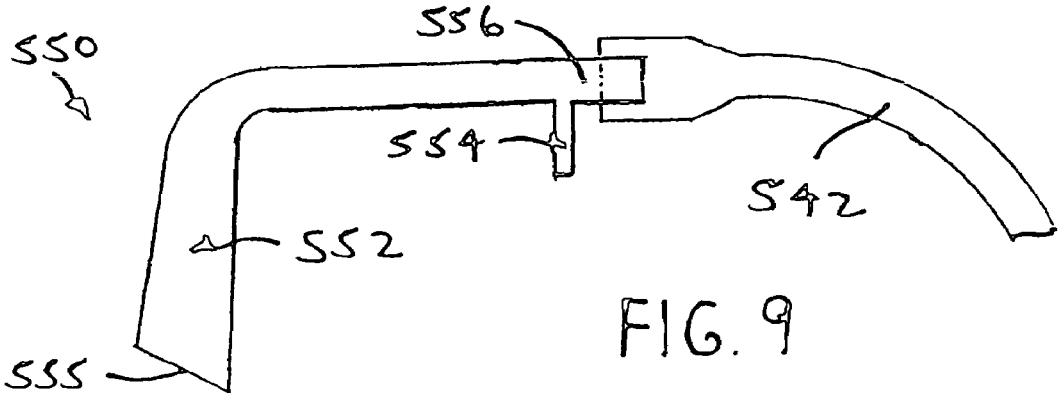
FIG. 9 is a diagrammatic side elevational view taken generally in the direction of ARROW 9 in FIG. 8.

As shown in FIGS. 7-9, which are, respectively, an enlarged diagrammatic front elevational view of the area generally enclosed by the dotted curve identified by ARROW 7 in FIG. 1 of a remaining portion of the first apparatus of the disposable air exhaust system of the present invention, a diagrammatic top plan view taken generally in the direction of ARROW 8 in FIG. 7, and, a diagrammatic side elevational view taken generally in the direction of ARROW 9 in FIG. 8, the first portion 30, 130, 230, 330, 430 further comprises a remaining portion 550.

The remaining portion 550 of the first apparatus 30, 130, 230, 330, 430 comprises a scoop 552 and hooks 554. The hooks 554 of the remaining portion 550 of the first apparatus 30, 130, 230, 330, 430 extend rearwardly from the scoop 552 of the remaining portion 550 of the first apparatus 30, 130, 230, 330, 430 and are for hooking over the back 29 of the rim 28 of the bowl 26 of the toilet 22 so as to allow the scoop 552 of the remaining portion 550 of the first apparatus 30, 130, 230, 330, 430 to lay inside of, and impart the suction at, the back 29 of the rim 28 of the bowl 26 of the toilet 22 to remove the offensive odorous particles and the offensive odorous air therefrom.

The scoop 552 of the remaining portion 550 of the first apparatus 30, 130, 230, 330, 430 has a mouth 555, and converges into a throat 556. The mouth 555 of the scoop 552 of the remaining portion 550 of the first apparatus 30, 130, 230, 330, 430 is for imparting the suction to remove the offensive odorous particles and the offensive odorous air, while the throat 556 of the scoop 552 of the remaining portion 550 of the first apparatus 30, 130, 230, 330, 430 extends into a tube 542 that fluidly communicates with the suction device 34 to transport the offensive odorous particles and the offensive odorous air from the mouth 555 of the scoop 552 of the remaining portion 550 of the first apparatus 30, 130, 230, 330, 430 to the suction device 34.

G. First Embodiment of the Second Apparatus

The configuration of a first embodiment of the second apparatus 632 can best be seen in FIG. 10, which is a diagrammatic bottom plan view of the area generally enclosed by the dotted curve identified by ARROW 10 in FIG. 1 of a first embodiment of the second apparatus of the disposable air exhaust system of the present invention, and as such, will be discussed with reference thereto.

The second apparatus 632 is similar to the first apparatus 330, except that the hook 336 of each pair of separate portions 346 of the first apparatus 330 is replaced by a flange 636 that extends laterally inwardly from the conduit 635 of an associated separate portion 646 of the second apparatus 632 and that is for disposably attaching to the bottom surface 25 of the seat 24 of the toilet 22 by an attaching apparatus 658.

H. First Embodiment of the Attaching Apparatus

The configuration of a first embodiment of the attaching apparatus 758 can best be seen in FIG. 11, which is an enlarged diagrammatic cross sectional view taken along LINE 11-11 in FIG. 10 of a first embodiment of the attaching apparatus of the first, second, and third embodiments of the second apparatus of the disposable air exhaust system of the present invention, and as such, will be discussed with reference thereto.

The attaching apparatus 758 comprises an adhesive 760. The adhesive 760 of the attaching apparatus 758 extends along the flange 636 of each separate portion 646 of the second apparatus 632.

I. Second Embodiment of the Attaching Apparatus

The configuration of a second embodiment of the attaching apparatus 858 can best be seen in FIG. 12, which is an enlarged diagrammatic cross sectional view taken along LINE 12-12 in FIG. 10 of a second embodiment of the attaching apparatus of the first, second, and third embodiments of the second apparatus of the disposable air exhaust system of the present invention, and as such, will be discussed with reference thereto.

The attaching apparatus 858 is similar to the attaching apparatus 758, except that the adhesive 760 of the attaching apparatus 758 is replaced by suction cups 860.

J. Second Embodiment of the Second Apparatus

The configuration of a second embodiment of the second apparatus 932 can best be seen in FIG. 13, which is a diagrammatic bottom plan view of the area generally enclosed by the dotted curve identified by ARROW 13 in FIG. 1 of a second embodiment of the second apparatus of the disposable air exhaust system of the present invention, and as such, will be discussed with reference thereto.

The second apparatus 932 is similar to the second apparatus 632, except that the conduit 935 of each separate portion 946 of the second apparatus 932 is flexible and the flange 936 of each separate portion 946 of the second apparatus 932 contains cutouts 944. The cutouts 944 in the flange 936 of each separate portion 946 of the second apparatus 932 are preferably V-shaped, are spaced therealong, extend laterally therein, and allow an associated conduit 935 of each separate portion 946 of the second apparatus 932 to flex and generally assume the shape of the seat 24 of the toilet 22.

K. Third Embodiment of the Second Apparatus

The configuration of the second apparatus 1032 can best be seen in FIG. 14, which is a diagrammatic bottom plan view of the area generally enclosed by the dotted curve identified by ARROW 14 in FIG. 1 of a third embodiment of the second apparatus of the disposable air exhaust system of the present invention, and as such, will be discussed with reference thereto.

The second apparatus 1032 is similar to the second apparatus 632, except that the flange 1036 of each separate portion 1046 of the second apparatus 1032 terminates in another conduit 1060 so as to provide a pair of conduits 1062 of each separate portion 1046 of the second apparatus 1032. The pair of conduits 1062 of each separate portion 1046 of the second apparatus 1032 are spaced-apart from, and are attached to, each other by the flange 1036 of an associated separate portion 1046 of the second apparatus 1032.

L. Suction Device

The configuration of the suction device 1134 can best be seen in FIG. 15, which is an enlarged diagrammatic side elevational view of the area generally enclosed by the dotted curve identified by ARROW 15 in FIG. 1 of the suction device of the disposable air exhaust system of the present invention, and as such, will be discussed with reference thereto.

The suction device 1134 comprises a housing 1164, a filter 1166, and a fragrance generator 1168. The housing 1164 has an openable top 1169, an intake 1170, and an exhaust 1171, and contains a first slot 1172 and a second slot 1174. Both the first slot 1172 in the housing 1164 of the suction device 1134 and the second slot 1174 in the housing 1164 of the suction device 1134 communicate with both the input 1170 of the housing 1164 of the suction device 1134 and the exhaust 1171 of the housing 1164 of the suction device 1134 so as the offensive odorous particles and the offensive odorous air enter the intake 1170 of the housing 1164 of the suction device 1134, the offensive odorous particles and the offensive odorous air pass first thorough the filter 1166 of the suction device 1134 to remove the offensive odorous particles and the offensive odorous air and form cleansed air that then passes through the fragrance generator 1168 of the suction device 1134 to have a fragrance imparted to the cleansed air to form fragranced air that exhausts through the exhaust 1171 of the suction device 1134.

The filter 1166 of the suction device 1134 is disposably received in the first slot 1172 in the housing 1164 of the suction device 1134, and is preferably a charcoal disk.

The fragrance generator 1168 of the suction device 1134 is disposably received in the second slot 1174 in the housing 1164 of the suction device 1134, and is preferably a scented disk.

The suction device 1134 further comprises a first tab 1176 and a second tab 1178. The first tab 1176 of the suction device 1134 is operatively connected to the filter 1166 of the suction device 1134 and is accessible from the openable top 1169 of the housing 1164 when opened to facilitate insertion into, and removal from, the first slot 1172 in the housing 1164 of the suction device 1134 of the filter 1166 of the suction device 1134. The second tab 1178 of the suction device 1134 is operatively connected to the fragrance generator 1168 of the suction device 1134 and is accessible from the openable top 1169 of the housing 1164 when opened to facilitate insertion into, and removal from, the second slot 1174 in the housing 1164 of the suction device 1134 of the fragrance generator 1168 of the suction device 1134.

It will be understood that each of the elements described above, or two or more together, may also find a useful application in other types of constructions differing from the types described above.

While the invention has been illustrated and described as embodied in a disposable air exhaust system for eliminating aerosol effect in a toilet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A disposable air exhaust system for eliminating aerosol effect in a toilet, wherein the toilet has a seat with a bottom surface, and wherein the toilet further has a bowl with a rim, said system comprising:

a) first means for disposably attaching directly to the rim of the bowl of the toilet and imparting a suction thereat to remove offensive odorous particles and offensive odorous air therefrom;

b) second means for disposably attaching to the seat of the toilet and imparting a suction thereat to remove offensive odorous particles and offensive odorous air therefrom; and c) a suction device;

wherein said suction device fluidly communicates with both said first means and said second means to create the suctions thereat to remove the offensive odorous particles and the offensive odorous air thereat, thereby eliminating the aerosol effect in the toilet;

wherein said second means is not continuous;

wherein said second means includes a pair of separate portions;

wherein each separate portion of said second means includes a conduit;

wherein each separate portion of said second means includes a flange;

wherein said flange of each separate portion of said second means extends laterally inwardly from said conduit of an associated separate portion of said second means;

wherein said flange of each separate portion of said second means is for disposably attaching to the bottom surface of the seat of the toilet by attaching means;

wherein said attaching means includes suction cups; and wherein said suction cups of said attaching means extend along said flange of each separate portion of said second means.

2. The system of claim 1, wherein said first means includes a conduit; and wherein said first means includes a hook.

3. The system of claim 2, wherein said hook of said first means extends laterally outwardly from said conduit of said first means; and wherein said hook of said first means is for hooking over the rim of the bowl of the toilet so as to allow said conduit of said first means to lay inside of, and impart the suction at, the rim of the bowl of the toilet to remove the offensive odorous particles and the offensive odorous air therefrom.

4. The system of claim 2, wherein said first means is continuous for extending continuously around the rim of the bowl of the toilet, thereby allowing both said hook of said first means and said conduit of said first means to extend continuously around the rim of the bowl of the toilet.

5. The system of claim 2, wherein said conduit of said first means has a plurality of openings;

wherein said plurality of openings in said conduit of said first means are spaced therealong in a depending manner; and wherein said plurality of openings in said conduit of said first means are for imparting the suction at the rim of the bowl of the toilet to remove the offensive odorous particles and the offensive odorous air therefrom.

6. The system of claim 2, wherein said conduit of said first means has a pair of ends;

wherein said pair of ends of said conduit of said first means extend into a pair of tubes; and wherein said pair of tubes of said first means fluidly communicate with said suction device to transport the offensive odorous particles and the offensive odorous air from said conduit of said first means to said suction device.

7. The system of claim 2, wherein said conduit of said first means is flexible.

8. The system of claim 2, wherein the rim of the bowl of the toilet has a shape;

wherein said hook of said first means contains cutouts;

wherein said cutouts in said hook of said first means are spaced therealong;

wherein said cutouts in said hook of said first means extend laterally therein; and wherein said cutouts in said hook of said first means allow said conduit of said first means to flex and generally assume the shape of the rim of the bowl of the toilet.

9. The system of claim 8, wherein said cutouts in said hook of said first means are generally V-shaped.

10. The system of claim 1, wherein said first means is not continuous; and wherein said first means includes a pair of separate portions.

11. The system of claim 10, wherein each separate portion of said first means has a conduit; and wherein each separate portion of said first means has a hook.

12. The system of claim 11, wherein said conduit of each separate portion of said first means has a distal end; and wherein said distal end of said conduit of each separate portion of said first means is sealed.

13. The system of claim 11, wherein said conduit of each separate portion of said first means has a proximal end;

wherein said proximal end of said conduit of each separate portion of said first means extends into a tube; and wherein said tube of said first means fluidly communicates with said suction device to transport the offensive odorous particles and the offensive odorous air from said conduit of each separate portion of said first means to said suction device.

14. The system of claim 11, wherein said conduit of each separate portion of said first means is flexible.

15. The system of claim 11, wherein said hook of each separate portion of said first means contains cutouts.

16. The system of claim 15, wherein said cutouts in said hook of each separate portion of said first means are spaced therealong;

wherein said cutouts in said hook of each separate portion of said first means extend laterally therein; and wherein said cutouts in said hook of each separate portion of said first means allow an associated conduit of each separate portion of said first means to flex and generally assume the shape of the rim of the bowl of the toilet.

17. The system of claim 16, wherein said cutouts in said hook of each separate portion of said first means are generally V-shaped.

18. The system of claim 11, wherein a remaining portion of said first means comprises a scoop; and wherein said remaining portion of said first means comprises hooks.

19. The system of claim 18, wherein said hooks of said remaining portion of said first means extend rearwardly from said scoop of said remaining portion of said first means; and wherein said hooks of said remaining portion of said first means are for hooking over the back of the rim of the bowl of the toilet so as to allow said scoop of said remaining portion of said first means to lay inside of, and impart the suction at, the back of the rim of the bowl of the toilet to remove the offensive odorous particles and the offensive odorous air therefrom.

20. The system of claim 18, wherein said scoop of said remaining portion of said first means has a mouth; and wherein said scoop of said remaining portion of said first means converges into a throat.

21. The system of claim 20, wherein said mouth of said scoop of said remaining portion of said first means is for imparting the suction at the back of the rim of the bowl of the toilet to remove the offensive odorous particles and the offensive odorous air therefrom; and wherein said throat of said scoop of said remaining portion of said first means extends into a tube that fluidly communicates with said suction device to transport the offensive odorous particles and the offensive odorous air from said mouth of said scoop of said remaining portion of said first means to said suction device.

22. The system of claim 1, wherein said conduit of each separate portion of said second means is flexible.

23. The system of claim 1, wherein said flange of each separate portion of said second means contains cutouts.

24. The system of claim 23, wherein said cutouts in said flange of each separate portion of said second means are V-shaped.

25. The system of claim 23, wherein said cutouts in said flange of each separate portion of said second means are spaced therealong;

wherein said cutouts in said flange of each separate portion of said second means extend laterally therein; and wherein said cutouts in said flange of each separate portion of said second means allow an associated conduit of each separate portion of said second means to flex and generally assume the shape of the seat of the toilet.

26. The system of claim 1, wherein said flange of each separate portion of said second means terminates in another conduit so as to provide a pair of conduits of each separate portion of said second means.

27. The system of claim 26, wherein said pair of conduits of each separate portion of said second means are space-apart from, and are attached to, each other by said flange of an associated separate portion of said second means.

28. The system of claim 1, wherein said suction device comprises a housing;

wherein said suction device comprises a filter; and wherein said suction device comprises a fragrance generator.

29. The system of claim 28, wherein said housing has an openable top;

wherein said housing has an intake;

wherein said housing has an exhaust;

wherein said housing contains a first slot; and wherein said housing contains a second slot.

30. The system of claim 29, wherein both said first slot in said housing of said suction device and said second slot in said housing of said suction device communicate with both said input of said housing of said suction device and said exhaust of said housing of said suction device so as the offensive odorous particles and the offensive odorous air enter said intake of said housing of said suction device, the offensive odorous particles and the offensive odorous air pass first thorough said filter of said suction device to remove the offensive odorous particles and the offensive odorous air and form cleansed air that then passes through said fragrance generator of said suction device to have a fragrance imparted to the cleansed air to form fragranced air that exhausts through said exhaust of said suction device.

31. The system of claim 29, wherein said filter of said suction device is disposably received in said first slot in said housing of said suction device.

32. The system of claim 29, wherein said fragrance generator of said suction device is disposably received in said second slot in said housing of said suction device.

33. The system of claim 29, wherein said suction device comprises a first tab;

wherein said first tab of said suction device is operatively connected to said filter of said suction device; and wherein said first tab of said suction device is accessible from said openable top of said housing when opened to facilitate insertion into, and removal from, said first slot in said housing of said suction device of said filter of said suction device.

34. The system of claim 29, wherein said suction device comprises a second tab;

wherein said second tab of said suction device is operatively connected to said fragrance generator of said suction device; and wherein said second tab of said suction device is accessible from said openable top of said housing when opened to facilitate insertion into, and removal from, said second slot in said housing of said suction device of said fragrance generator of said suction device.

35. The system of claim 28, wherein said filter of said suction device is a charcoal disk.

36. The system of claim 28, wherein said fragrance generator of said suction device is a scented disk.

* * * * *